US010176760B2

(12) United States Patent
Park et al.

(10) Patent No.: US 10,176,760 B2
(45) Date of Patent: Jan. 8, 2019

(54) ORGANIC LIGHT EMITTING DISPLAY AND DRIVING METHOD THEREOF

(71) Applicant: LG Display Co., Ltd., Seoul (KR)

(72) Inventors: KiSu Park, Gyeonggi-do (KR); JeongHwan Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 16 days.

(21) Appl. No.: 15/416,536

(22) Filed: Jan. 26, 2017

(65) Prior Publication Data

US 2017/0140708 A1 May 18, 2017

Related U.S. Application Data

(62) Division of application No. 14/568,452, filed on Dec. 12, 2014, now Pat. No. 9,607,547.

(30) Foreign Application Priority Data

Dec. 17, 2013 (KR) ..... 10-2013-0157565

(51) Int. Cl.

| | |
|---|---|
| ***G09G 3/3258*** | (2016.01) |
| ***G09G 3/3266*** | (2016.01) |
| ***G09G 3/3291*** | (2016.01) |
| ***G09G 3/3233*** | (2016.01) |

(52) U.S. Cl.

CPC ..... *G09G 3/3258* (2013.01); *G09G 3/3233* (2013.01); *G09G 3/3266* (2013.01); *G09G 3/3291* (2013.01); *G09G 2300/0819* (2013.01); *G09G 2310/08* (2013.01); *G09G 2320/0233* (2013.01); *G09G 2320/045* (2013.01); *G09G 2320/048* (2013.01); *G09G 2320/0626* (2013.01)

(58) Field of Classification Search

CPC ..... G09G 2320/043; G09G 2320/048; G09G 3/3291; G09G 3/3258

See application file for complete search history.

(56) References Cited

U.S. PATENT DOCUMENTS

| | | | | |
|---|---|---|---|---|
| 2005/0030267 | A1* | 2/2005 | Tanghe | G09G 3/3216 345/82 |
| 2007/0152920 | A1 | 7/2007 | Yamashita et al. | |
| 2009/0315813 | A1 | 12/2009 | Uchino et al. | |
| 2010/0277460 | A1 | 11/2010 | Sato | |

(Continued)

FOREIGN PATENT DOCUMENTS

| | | | |
|---|---|---|---|
| CN | 101021998 | A | 8/2007 |
| CN | 101615381 | A | 12/2009 |
| CN | 103035196 | A | 4/2013 |

OTHER PUBLICATIONS

Office Action dated Sep. 1, 2016, issued by the Chinese Patent Office in Chinese Patent Application No. 201410784714.6.

*Primary Examiner* — Md Saiful A Siddiqui
(74) *Attorney, Agent, or Firm* — Morgan, Lewis & Bockius LLP

(57) ABSTRACT

Disclosed are an organic light emitting display capable of preventing lowering of brightness and prolonging its a lifespan, and a driving method thereof. The organic light emitting display controls a level of a gate signal, by outputting a gate high voltage after controlling a level of the gate high voltage, according to a level of a threshold voltage sensed from each pixel of a display panel.

3 Claims, 7 Drawing Sheets

(56) References Cited

U.S. PATENT DOCUMENTS

| | | | | |
|---|---|---|---|---|
| 2011/0227505 | A1* | 9/2011 | Park | H05B 33/0896 315/297 |
| 2011/0254871 | A1 | 10/2011 | Yoo | |
| 2012/0050350 | A1 | 3/2012 | Matsui | |
| 2013/0083087 | A1 | 4/2013 | Byun et al. | |
| 2014/0118322 | A1* | 5/2014 | Kim | G09G 3/3233 345/212 |

* cited by examiner

ORGANIC LIGHT EMITTING DISPLAY AND DRIVING METHOD THEREOF

CROSS-REFERENCE TO RELATED APPLICATION

This application is a divisional application of copending U.S. application Ser. No. 14/568,452, filed Dec. 12, 2014, which claims the benefit of the earlier filing date and right of priority to Korean Application No. 10-2013-0157565, filed on Dec. 17, 2013, the contents of which are incorporated by reference herein in their entirety.

BACKGROUND OF THE INVENTION

1. Field of the Invention

This specification relates to an organic light emitting display, and more particularly, an organic light emitting display capable of preventing brightness reduction by compensating for degradation of a device due to change of a threshold voltage, and a driving method thereof.

2. Background of the Invention

As information society develops, demands for display devices for displaying images increase in various manners. Recently, various flat display devices such as liquid crystal displays (LCDs), plasma display panels (PDPs), and organic light emitting diodes (OLEDs) are being utilized.

Among such flat display devices, the OLEDs have advantages such as a low voltage driving, a thin thickness, an excellent viewing angle, and a fast response speed. As the OLEDs, active matrix type OLEDs for displaying images as pixels are arranged in the form of matrices are being widely used.

FIG. 1 is a view illustrating a configuration of an organic light emitting display in accordance with the related art, and FIG. 2 is an equivalent circuit diagram with respect to a single pixel of FIG. 1.

Referring to the drawings, the related art organic light emitting display 1 includes a display panel 2, a timing controller 3, a driving voltage generator 4, a gate driving unit 5, and a data driving unit 6.

The display panel 2 is configured to display images, and a plurality of gate lines (GL1~GLn) and a plurality of data lines (DL1~DLm) for defining pixel regions by crossing each other are formed at the display panel 2.

As shown in FIG. 2, a pixel (P) is formed at each pixel region. The pixel (P) includes a switching transistor (ST), a capacitor (C), a driving transistor (DR) and an organic light emitting diode (OLED) each formed between a gate line (GL1) and a data line (DL1). Each transistor (ST, DR) is a thin film transistor (TFT) formed of amorphous silicon (a-Si:H).

The switching transistor (ST) of the pixel (P) may have a gate electrode connected to a gate line (GL1), a source electrode connected to a data line (DL1), and a drain electrode connected to a gate electrode of the driving transistor (DR). The switching transistor (ST) supplies a data signal supplied to the data line (DL1) to the driving transistor (DR), according to a gate signal supplied to the gate line (GL1).

Further, the driving transistor (DR) may have a gate electrode connected to the drain electrode of the switching transistor (ST), a source electrode connected to the OLED, and a drain electrode connected to a line for supplying a power voltage (VDD). The driving transistor (DR) controls the amount of current flowing to the OLED from the power voltage (VDD), according to a data signal supplied from the switching transistor (ST).

The capacitor (C) is connected between the gate electrode of the driving transistor (DR) and the OLED. The capacitor (C) stores therein a voltage corresponding to a data signal supplied to the gate electrode of the driving transistor (DR), and constantly maintains an 'ON' state of the driving transistor (DR) for a single frame using the stored voltage.

The timing controller 3 generates image data (R', G', B') by converting image signals (R, G, B) provided from the outside, and outputs the generated image data to the data driving unit 6.

The timing controller 3 generates gate control signals (CNT1) and data control signals (CNT2) from a control signal (CTN) provided from the outside, and outputs the generated signals to the gate driving unit 5 and the data driving unit 6, respectively.

The data driving unit 6 is connected to the plurality of data lines (DL1~DLm) of the display panel 2, and generates data signals using the data control signals (CNT2) and the image data (R', G', B') received from the timing controller 3. The data signals are supplied to the plurality of data lines (DL1~DLm) of the display panel 2.

The driving voltage generator 4 generates a gate high voltage (Vgh) and a gate low voltage (Vgl), and outputs the generated voltages to the gate driving unit 5.

The gate driving unit 5 is connected to the plurality of gate lines (GL1~GLn) of the display panel 2, and generates gate signals using the signals provided from the driving voltage generator 4 (i.e., the gate high voltage (Vgh) and the gate low voltage (Vgl)), according to the gate control signals (CNT1) received from the timing controller 3. The gate signals are supplied to the plurality of gate lines (GL1~GLn) of the display panel 2.

In the related art organic light emitting display 1, the switching device of the pixel (P), i.e., the switching transistor (ST) and the driving transistor (DR) are degraded as time lapses, and thus a threshold voltage (Vth) of the switching device is changed.

FIG. 3 is a graph illustrating a brightness change according to a threshold voltage change, in the related art organic light emitting display.

Referring to FIG. 3, in the related art organic light emitting display 1, a threshold voltage (Vth) of a switching device of a pixel (P) is gradually increased as time lapses.

As the threshold voltage (Vth) is increased, a non-uniform amount of current flows to the OLED, even if a data signal of the same level is applied to the switching device (i.e., the switching transistor ST). As a result, brightness of the display panel 2 is gradually reduced as time lapses. This may lower a lifespan of the organic light emitting display 1.

SUMMARY OF THE INVENTION

Accordingly, the present invention is directed to an organic light emitting display and a driving method thereof that substantially obviates one or more of the problems due to limitations and disadvantages of the related art.

Therefore, an object of the present invention is to provide an organic light emitting display capable of preventing lowering of brightness due to change of a threshold voltage, by providing a gate signal to a display panel, after changing a level of the gate signal according to a set time or a set threshold voltage, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of this specification, as embodied and broadly described herein, an organic light emitting display comprises a display panel including a plurality of gate lines, a plurality of data line, and a plurality of pixels disposed at intersections between the gate lines and the data lines, wherein the pixel is provided with a switching transistor, a driving transistor and an organic light emitting diode; a driving voltage generator configured to sense a threshold voltage at each pixel of the display panel, and to output a gate high voltage after controlling a level of an original gate high voltage according to a level of the threshold voltage; and a gate driving unit configured to generate a gate signal according to a level-controlled gate high voltage output from the driving voltage generator, and to supply the generated gate signal to the switching transistor through the gate lines.

In another aspect, an organic light emitting display comprises a display panel including a plurality of gate lines, a plurality of data line, a plurality of sensing lines, and a plurality of pixels disposed at intersections between the gate lines and the data lines, wherein the pixel is provided with a switching transistor, a driving transistor, a sensing transistor and an organic light emitting diode; a driving voltage generator configured to count an operation time of the display panel, and to output a gate high voltage after controlling a level of an original gate high voltage according to the counted operation time; a gate driving unit configured to generate a gate signal according to a level-controlled gate high voltage output from the driving voltage generator, and to supply the generated gate signal to the switching transistor through the gate lines; and a light emission controller configured to generate a light emission signal according to the level-controlled gate high voltage output from the driving voltage generator, and to supply the generated light emission signal to the sensing transistor through the sensing lines.

In yet another aspect, a method of driving an organic light emitting display comprises sensing a threshold voltage from a display panel including pixels disposed at intersections between a plurality of gate lines and a plurality of data lines, each pixel provided with a switching transistor, a driving transistor, a sensing transistor and an organic light emitting diode; comparing the threshold voltage with a reference voltage, and outputting a comparison result; and controlling a level of an original gate high voltage according to the comparison result, and outputting a level-controlled gate high voltage.

In a further aspect, a method of driving an organic light emitting display comprises counting an operation time of a display panel including pixels disposed at intersections between a plurality of gate lines and a plurality of data lines, each pixel provided with a switching transistor, a driving transistor, a sensing transistor and an organic light emitting diode comparing the counted operation time with a reference time, and outputting a coefficient value; and controlling a level of a gate high voltage according to the coefficient value, and outputting a level-controlled gate high voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings.

DETAILED DESCRIPTION OF THE INVENTION

Description will now be given in detail to example embodiments of the present invention, examples of which are illustrated in the accompanying drawings.

Hereinafter, an organic light emitting display and a driving method thereof according to the present invention will be explained in more detail with reference to the attached drawings.

Figure 1:
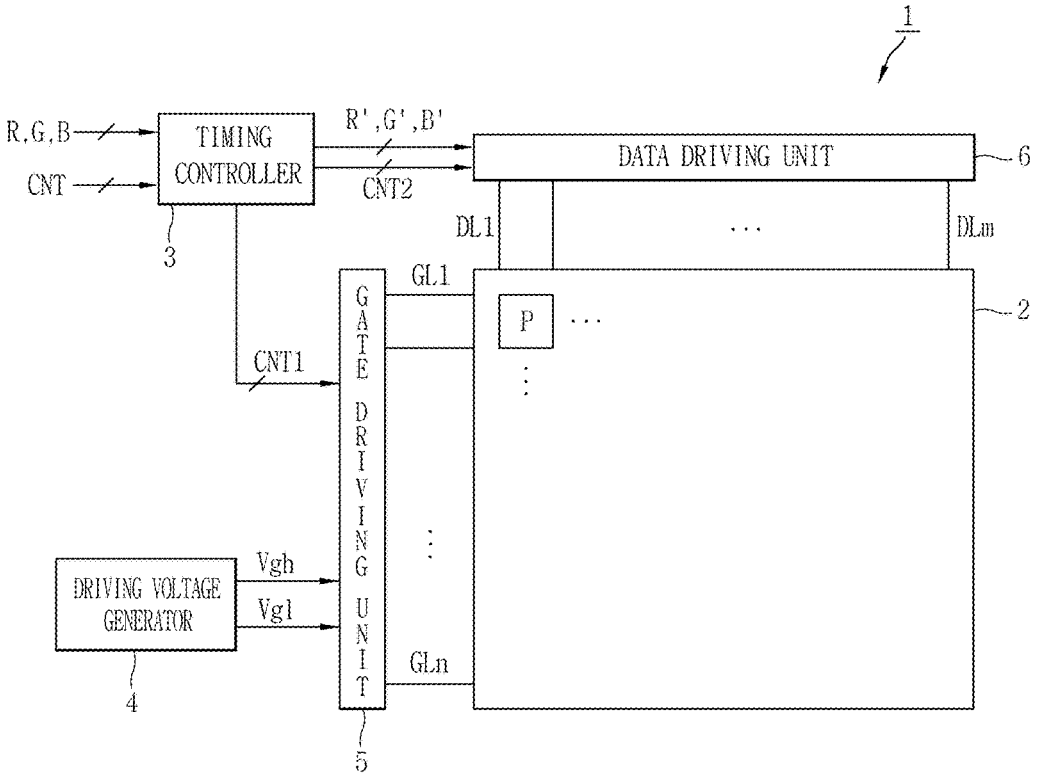
FIG. 1 RELATED ART
FIG. 1 is a view illustrating a configuration of an organic light emitting display in accordance with the related art.
Figure 2:
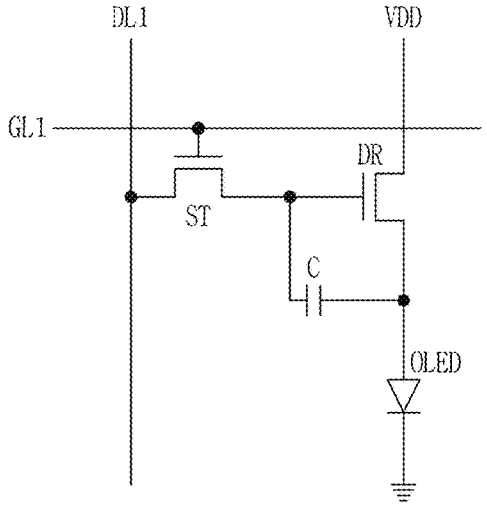
FIG. 2 RELATED ART
FIG. 2 is an equivalent circuit diagram with respect to a single pixel of FIG. 1.
Figure 3:
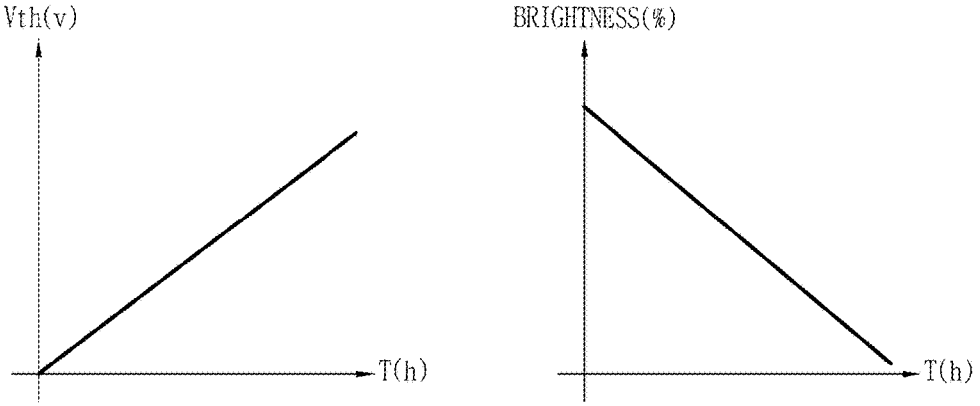
FIG. 3 RELATED ART
FIG. 3 is a graph illustrating a brightness change according to a threshold voltage change, in a related art organic light emitting display.
Figure 4:
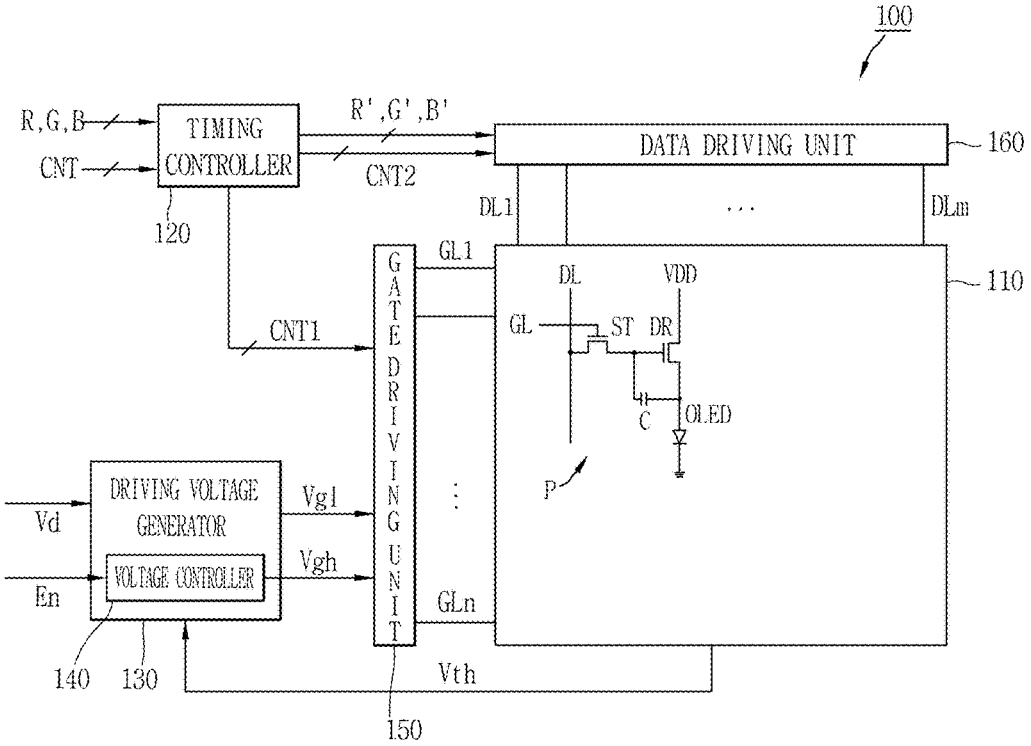
FIG. 4 is a view illustrating a configuration of an organic light emitting display according to an embodiment of the present invention.

FIG. 4 is a view illustrating a configuration of an organic light emitting display according to an embodiment of the present invention.

Referring to FIG. 4, an organic light emitting display according to an embodiment of the present invention 100 may include a display panel 110, a timing controller 120, a driving voltage generator 130, a gate driving unit 150, and a data driving unit 160.

The display panel 110 is an organic light emitting panel where an image is displayed, and a plurality of gate lines (GL1~GLn) and a plurality of data lines (DL1~DLm) may be formed to cross each other on the display panel 110. A pixel (P) may be formed at each intersection between the plurality of gate lines (GL1~GLn) and the plurality of data lines (DL1~DLm).

The pixel (P) may have a 2T(transistor)1C(Capacitor) structure, where two switching devices (i.e., a switching transistor (ST) and a driving transistor (DR)), a single capacitor (C) and a single organic light emitting diode (OLED) are formed.

The switching transistor (ST) of the pixel (P) may have a gate electrode connected to a gate line (GL), a source electrode connected to a data line (DL), and a drain electrode connected to a driving transistor (DR).

Further, the driving transistor (DR) may have a gate electrode connected to the drain electrode of the switching transistor (ST), a source electrode connected to the OLED, and a drain electrode connected to a power voltage (VDD).

The capacitor (C) of the pixel (P) may be connected between the gate electrode of the driving transistor (DR) and the OLED.

The switching transistor (ST) of the pixel (P) is turned on by a gate signal supplied to the gate line (GL), and the capacitor (C) is charged by a data signal supplied to the data line (DL). The amount of current flowing on a channel of the driving transistor (DR) may be determined according to a potential difference between a voltage charged to the capacitor (C) and the power voltage (VDD). And the amount of light to be emitted may be determined by the determined amount of current, so that the OLED can emit light.

That is, the switching transistor (ST) of the pixel (P) may serve as a switching device for supplying a data signal to the driving transistor (DR), and the driving transistor (DT) of the pixel (P) may serve as a driving device for driving the OLED according to a data signal.

The aforementioned display panel 110 may be formed by forming gate lines (GL1~GLn), data lines (DL1~DLm) and pixels (P) on a first substrate through processes such as deposition and photolithography, and by attaching a second substrate onto the first substrate.

The timing controller 120 may generate gate control signals (CNT1) and data control signals (CNT2) from a control signal (CNT) provided from the outside, and may output the gate control signals (CNT1) and the data control signals (CNT2) to the gate driving unit 150 and the data driving unit 160, respectively.

For instance, a control signal (CNT), such as a vertical synchronization signal, a horizontal synchronization signal, a clock signal and a data enable signal, may be provided to the timing controller 120 from the outside. The timing controller 120 may generate gate control signals (CNT1) including a start signal, a shift signal, an output enable signal, etc., from the control signal (CNT), and may output the generated gate control signals (CNT1) to the gate driving unit 150. Further, the timing controller 120 may generate data control signals (CNT2) including a start signal, a sampling signal, an output enable signal, etc., from the control signal (CNT), and may output the generated data control signals (CNT2) to the data driving unit 160.

The timing controller 120 may convert image signals (R, G, B) provided from the outside, into image data (R', G', B'), and may output the image data (R', G', B') to the data driving unit 160.

The driving voltage generator 130 may generate a plurality of driving voltages such as a gate high voltage (Vgh), a gate low voltage (Vgl) and a common voltage (Vcom), from an operating voltage (Vd) provided from the outside. The driving voltage generator 130 may output a gate high voltage (Vgh) and a gate low voltage (Vgl), to the gate driving unit 150.

The driving voltage generator 130 may further include a voltage controller 140. The voltage controller 140 may generate a gate high voltage (Vgh) from an operating voltage (Vd), according to a control signal, e.g., an enable signal (En). Then, the voltage controller 140 may output the generated gate high voltage (Vgh) after controlling a level of the gate high voltage (Vgh) according to a condition.

The reason why the voltage controller 140 outputs a gate high voltage (Vgh) after controlling a level of the gate high voltage (Vgh) according to a condition, is in order to prevent degradation of an OLED by compensating for change of a threshold voltage (Vth) of the switching transistor (ST) at each pixel (P) of the display panel 110. A configuration and an operation of the voltage controller 140 will be explained later in more detail.

The gate driving unit 150 may generate gate signals, from a gate high voltage (Vgh) and a gate low voltage (Vgl) output from the driving voltage generator 130, according to gate control signals (CNT1) output from the timing controller 120. The generated gate signals may be sequentially output to the plurality of gate lines (GL1~GLn) of the display panel 110.

Once the gate high voltage (Vgh) is output after its level has been controlled by the voltage controller 140, the gate driving unit 150 may generate a gate signal after a level control, in correspondence to the level control of the gate high voltage (Vgh).

The data driving unit 160 may generate data signals using image data (R', G', B'), according to data control signals (CNT2) output from the timing controller 120. The generated data signals may be output to the plurality of data lines (DL1~DLm) of the display panel 110.

The organic light emitting display 100 according to this embodiment may further include a gamma voltage generator (not shown). The gamma voltage generator may generate a plurality of gamma voltages, and may output the generated gamma voltages to the data driving unit 160. The data driving unit 160 may generate data signals from image data (R', G', B'), according to the generated gamma voltages. The gamma voltages may be composed of positive voltages and negative voltages.

Figure 5:
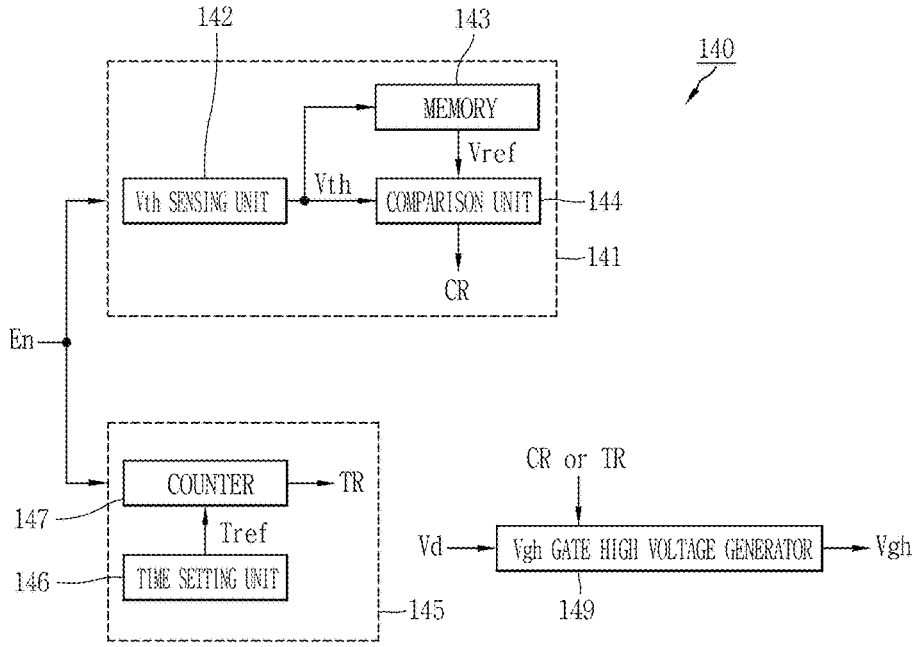
FIG. 5 is a view illustrating a detailed configuration of a voltage controller of FIG. 4.

FIG. 5 is a view illustrating a detailed configuration of the voltage controller 140 of FIG. 4.

Referring to FIGS. 4 and 5, the voltage controller 140 may be composed of three modules, e.g., a sensing module 141, a driving time check module 145 and a voltage control module 149.

The sensing module 141 may sense a threshold voltage (Vth) of the display panel 110, thereby outputting a predetermined comparison result (CR). The sensing module 141 may include a sensing unit 142, a comparison unit 144 and a memory 143.

The sensing unit 142 may sense a threshold voltage (Vth) from each pixel (P) of the display panel 110, i.e., a threshold voltage (Vth) from the switching transistor (ST) of each pixel (P).

The sensing unit 142 may sense a threshold voltage (Vth) at intervals of every frame or at intervals of a predetermined number of frames of the display panel 110.

The comparison unit 144 may compare the threshold voltage (Vth) sensed by the sensing unit 142, with a reference voltage (Vref). The reference voltage (Vref) may be a voltage stored in the memory 143, which may be a threshold voltage sensed by the sensing unit 142 at a previous sensing operation.

The comparison unit 144 may compare the threshold voltage (Vth) with the reference voltage (Vref), thereby outputting a comparison result (CR). For instance, if the threshold voltage (Vth) is greater than the reference voltage (Vref), the comparison unit 144 may output a comparison result (CR). The comparison result (CR) output from the comparison unit 144 may be a pulse having a first level, e.g., a positive (+) level.

The memory 143 may store therein the threshold voltage (Vth) sensed by the sensing unit 142. The stored threshold voltage (Vth) may be used as a reference voltage (Vref) when the comparison unit 144 performs a next comparison process.

The driving time check module 145 may count an operation time of the display panel 110, and may output a predetermined coefficient value (TR) from the counted operation time. The driving time check module 145 may include a time setting unit 146 and a counter 147.

In the time setting unit 146, a reference time (Tref) set by a user is stored.

For instance, a user may set one or more reference times (Tref) among a total operation time of the display panel 110. The reference time (Tref) may be an accumulated operation time of the display panel 110, set in unit of hours, e.g., 100 hours, 1000 hours, etc.

The counter 147 may count an operation time of the display panel 110. The counter 147 may count an operation time of the display panel 110, in unit of hours. That is, the counter 147 may count time taken from an initial time point when an image is displayed as each pixel (P) of the display panel 110 is operated, to a time point when the operation of the display panel 110 is completed, in an accumulated manner.

If the counted operation time of the display panel 110 is equal to or greater than the reference time (Tref) provided from the time setting unit 146, the counter 147 may output a predetermined coefficient value (TR). The coefficient value (TR) may be a total operation time of the display panel 110 counted by the counter 147.

The driving time check module 145 may be configured to use a timer (not shown). For instance, the driving time check module 145 may check an operation time of the display panel 110 using a timer, and may output a signal such as an alarm from the timer, when the checked operation time is equal to or greater than the reference time (Tref) set by a user.

One of the sensing module 141 and the driving time check module 145 may be operated, or both of the sensing module 141 and the driving time check module 145 may be operated, according to a control signal provided from the outside, e.g., an enable signal (En) provided from the timing controller 120.

The voltage control module 149 may generate a gate high voltage (Vgh) after controlling a level of the gate high voltage (Vgh), from an operating voltage (Vd) provided from the outside. Such voltage control module 149 may be a gate high voltage generator 149.

The gate high voltage generator 149 may generate a level-controlled gate high voltage (Vgh), from an operating voltage (Vd), according to a comparison result (CR) output from the sensing module 141, or a coefficient value (TR) output from the driving time check module 145. Then, the gate high voltage generator 149 may output the generated level-controlled gate high voltage (Vgh).

The gate high voltage generator 149 may output a gate high voltage (Vgh) reduced in level than the original gate high voltage, according to a comparison result (CR) or a coefficient value (TR).

The level-reduced gate high voltage (Vgh) output from the gate high voltage generator 149 is provided to the gate driving unit 150. The gate driving unit 150 generates a gate signal using the gate high voltage (Vgh). In this instance, the gate driving unit 150 may generate a gate signal reduced in level than the original gate signal. Then, the gate driving unit 150 may output the generated gate signal to the switching transistor (ST) of each pixel (P), through the gate line (GL) of the display panel 110.

Hereinafter, an operation of the organic light emitting display 100 including the aforementioned voltage controller 140 according to an embodiment of the present invention, will be explained in more detail with reference to the attached drawings.

Figure 6:
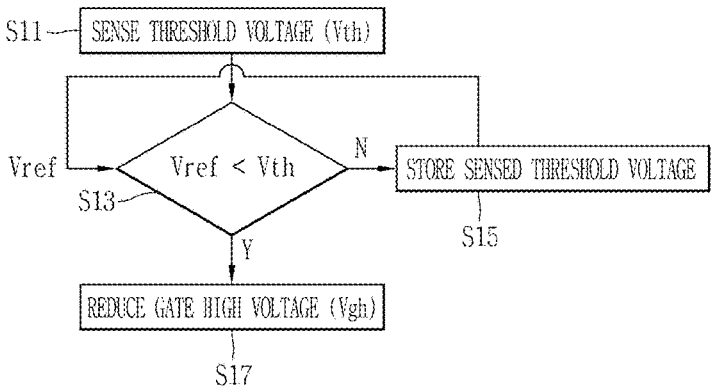
FIG. 6 is a flowchart illustrating operations of the organic light emitting display of FIG. 4 according to an embodiment of the present invention.

FIG. 6 is a flowchart illustrating operations of the organic light emitting display of FIG. 4 according to an embodiment of the present invention.

Referring to FIGS. 4 to 6, the voltage controller 140 of the driving voltage generator 130 may sense a threshold voltage (Vth) at each pixel (P) of the display panel 110 (S11).

For instance, the sensing module 141 of the voltage controller 140 may be operated by an enable signal (En) provided from the timing controller 120. The sensing unit 142 of the sensing module 141 may sense a threshold voltage (Vth) of the switching transistor (ST) at each pixel (P).

Then, the sensed threshold voltage (Vth) is provided to the comparison unit 144, and the comparison unit 144 may compare the threshold voltage (Vth) with a reference voltage (Vref) (S13).

In this case, the comparison unit 144 may use a threshold voltage previously-sensed to be stored in the memory 143, as the reference voltage (Vref).

If the sensed threshold voltage (Vth) is greater than the reference voltage (Vref) as a comparison result (Y), the comparison unit 144 may output a comparison result (CR). The comparison result (CR) may be output to the gate high voltage generator 149.

The comparison unit 144 may output the comparison result (CR) when the threshold voltage (Vth) is greater than the reference voltage (Vref) by a predetermined level. For instance, when the threshold voltage (Vth) is greater than the reference voltage (Vref) by a positive integer (+) (e.g., 1V, 2V, etc.), the comparison unit 144 may output the comparison result (CR).

The gate high voltage generator 149 may generate a gate high voltage (Vgh) from an operating voltage (Vd), according to the comparison result (CR) output from the comparison unit 144. The generated gate high voltage (Vgh) may be reduced in level than the original gate high voltage (S17).

The gate high voltage generator 149 may generate a gate high voltage (Vgh) reduced in level than the original gate high voltage by a predetermined level. The gate high voltage generator 149 may generate a gate high voltage (Vgh) reduced in level than the original gate high voltage by a negative integer (−) (e.g., −1V, −2V, etc.). In this case, a data signal of the level-reduced gate high voltage (Vgh) may influence on the amount of current charged to the capacitor (C) of the pixel (P). Therefore, the gate high voltage generator 149 should generate a level-reduced gate high voltage (Vgh) with consideration of the amount of a data signal to be charged.

The gate high voltage (Vgh) generated from the gate high voltage generator 149 may be output to the gate driving unit 150, and the gate driving unit 150 may generate a gate signal reduced in level than the original gate signal using the generated gate high voltage (Vgh). The level-reduced gate signal may be output to the switching transistor (ST) of each pixel (P), through the gate line (GL) of the display panel 110.

That is, in this embodiment, a level of a gate signal provided to a gate electrode of a switching transistor (ST) of each pixel (P) is controlled according to a level of a threshold voltage (Vth) sensed by the switching transistor (ST). As a result, a change of the threshold voltage (Vth) of the switching transistor (ST) can be compensated, and thus the amount of current provided to the OLED can be increased. This can increase brightness of the display panel 110, and prevent degradation of each pixel (P), thereby increasing a lifespan of the organic light emitting display 100.

If the sensed threshold voltage (Vth) is smaller than the reference voltage (Vref) as a comparison result by the comparison unit 144 (N), the sensed threshold voltage (Vth) may be stored in the memory 143 (S15). The stored threshold voltage (Vth) may be used as a reference voltage (Vref) when the comparison unit 144 performs a next comparison process.

In this embodiment, the display panel 110 of the sensing module 141 senses a threshold voltage (Vth) of the switching transistor (ST) at each pixel (P). However, the present invention is not limited to this. That is, the sensing module 141 may sense a threshold voltage of the driving transistor (DR) at each pixel (P) of the display panel 110, and may output a comparison result. And a level of a gate signal supplied to the switching transistor (ST) may be controlled according to the comparison result.

Figure 7:
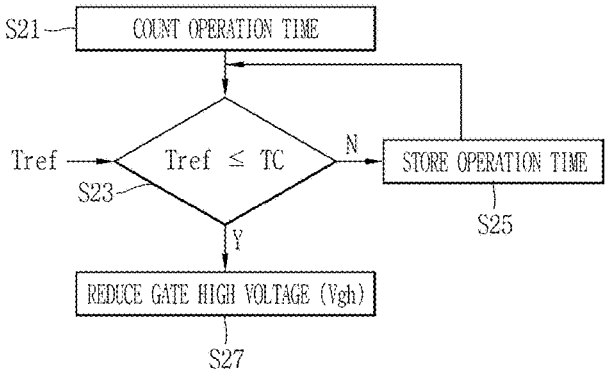
FIG. 7 is a flowchart illustrating operations of the organic light emitting display of FIG. 4 according to another embodiment of the present invention.

FIG. 7 is a flowchart illustrating operations of the organic light emitting display of FIG. 4 according to another embodiment of the present invention.

Referring to FIGS. 4, 5 and 7, the voltage controller 140 of the driving voltage generator 130 may count an operation time of the display panel 110 (S21).

The driving time check module 145 of the voltage controller 140 may be operated according to an enable signal (En) provided from the timing controller 120. The counter 147 of the driving time check module 145 may count an operation time of the display panel 110 from an initial operation time point, in unit of hours.

The counted operation time may be compared with a reference time (Tref) stored in the time setting unit 146 (S23).

If the counted operation time is greater than or equal to the reference time (Tref) as a comparison result (Y), the counter 147 may output a coefficient value (TR). The coefficient value (TR) may be a counted operation time of the display panel 110. The coefficient value (TR) may be output to the gate high voltage generator 149.

The gate high voltage generator 149 may generate a gate high voltage (Vgh) from an operating voltage (Vd), according to the coefficient value (TR) output from the counter 147. The generated gate high voltage (Vgh) may be a voltage reduced in level than the original gate high voltage (S27).

The gate high voltage generator 149 may generate a gate high voltage (Vgh) reduced in level than the original gate high voltage by a predetermined value. For instance, the gate high voltage generator 149 may generate a gate high voltage (Vgh) reduced in level than the original gate high voltage by an integer, e.g., a negative integer (−) such as −1V and −2V.

The gate high voltage (Vgh) generated from the gate high voltage generator 149 may be output to the gate driving unit 150, and the gate driving unit 150 may generate a gate signal reduced in level than the original gate signal, using the generated gate high voltage (Vgh). The generated gate signal may be output to the switching transistor (ST) of each pixel (P), through the gate line (GL) of the display panel 110.

That is, in this embodiment, a level of a gate signal provided to a gate electrode of a switching transistor (ST) of each pixel (P) is controlled according to an operation time of the organic light emitting display 100. As a result, a threshold voltage (Vth) of the switching transistor (ST), which is variable according to an operation time of the organic light emitting display 100, can be compensated. Therefore, the amount of current provided to the OLED can be increased. This can increase brightness of the display panel 110, prevent degradation of each pixel (P), and increase a lifespan of the organic light emitting display 100.

If the counted operation time is smaller than the reference time (Tref) as a comparison result (N), the counter 147 may store the counted operation time of the display panel 110 by accumulating a coefficient value (TR) at a next counting operation (S25).

Figure 8:
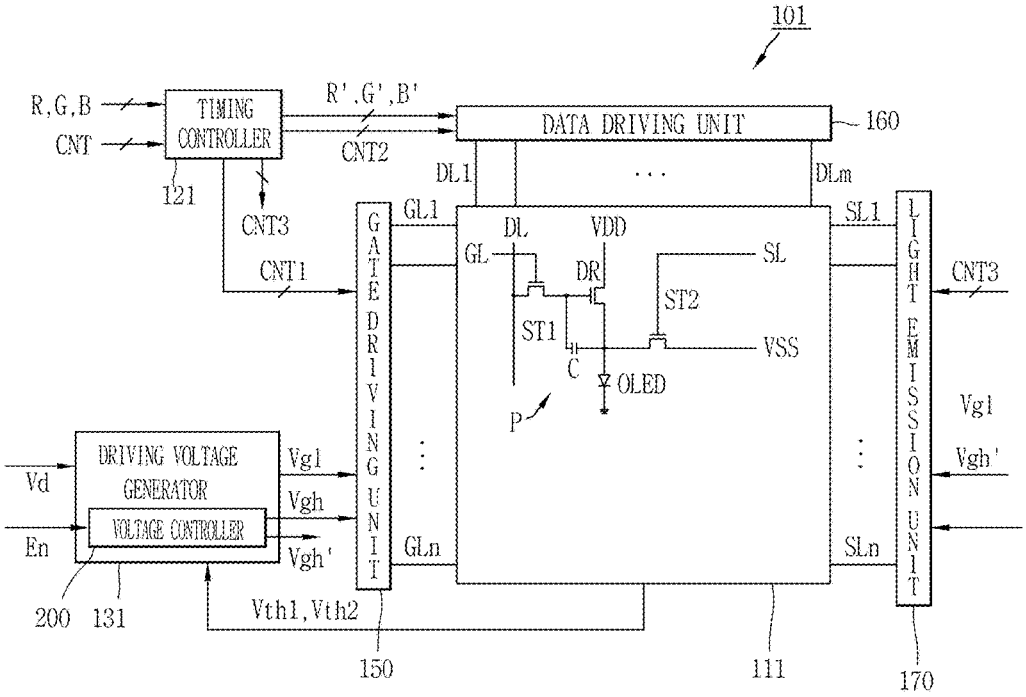
FIG. 8 is a view illustrating a configuration of an organic light emitting display according to another embodiment of the present invention.

FIG. 8 is a view illustrating a configuration of an organic light emitting display according to another embodiment of the present invention.

Referring to FIG. 8, the organic light emitting display according to another embodiment of the present invention 101 may include a display panel 111, a timing controller 121, a driving voltage generator 131, a gate driving unit 150, a light emission controller 170, and a data driving unit 160.

The display panel 111 is an organic light emitting panel, and a plurality of gate lines (GL1~GLn) and a plurality of data lines (DL1~DLm) may be formed at the display panel 111 so as to cross each other. A pixel (P) may be formed at each intersection between the plurality of gate lines (GL1~GLn) and the plurality of data lines (DL1~DLm).

A plurality of sensing lines (SL1~SLn) having the same number as the plurality of gate lines (GL1~GLn) may be formed at the display panel 111 in parallel to the plurality of gate lines (GL1~GLn).

The pixel (P) may have a 3T(Transistor)1C(Capacitor) structure, where three switching devices (i.e., a switching transistor (ST1), a driving transistor (DR), and a sensing transistor (ST2)), a single capacitor (C) and a single organic light emitting diode (OLED) are formed.

The switching transistor (ST1) of the pixel (P) may have a gate electrode connected to the gate line (GL), a source electrode connected to the data line (DL), and a drain electrode connected to the driving transistor (DR).

Further, the driving transistor (DR) may have a gate electrode connected to the drain electrode of the switching transistor (ST1), a source electrode connected to the OLED, and a drain electrode connected to a power voltage (VDD).

The sensing transistor (ST2) of the pixel (P) may have a gate electrode connected to the sensing line (SL), a source electrode connected to the source electrode of the driving transistor (DR), and a drain electrode connected to a ground voltage (VSS).

The capacitor (C) of the pixel (P) may be connected between the gate electrode of the driving transistor (DR) and the OLED.

The switching transistor (ST) of the pixel (P) is turned on by a gate signal supplied to the gate line (GL), and the capacitor (C) is charged by a data signal supplied to the data line (DL). The amount of current flowing on a channel of the driving transistor (DR) may be determined according to a potential difference between a voltage charged to the capacitor (C) and the power voltage (VDD). And the amount of light to be emitted may be determined by the determined amount of current, so that the OLED can emit light. In this case, the sensing transistor (ST2) is turned on by a sensing signal provided through the sensing line (SL), and can prevent the OLED from emitting light by the power voltage (VDD), before the capacitor (C) is charged by a data signal during an initial operation of the switching transistor (ST1).

The timing controller 121 may generate a gate control signal (CNT1), a data control signal (CTN2) and a light emission control signal (CNT3), from a control signal (CNT) provided from the outside, and may output the generated signals to the gate driving unit 150, the data driving unit 160 and the light emission controller 170, respectively.

The timing controller 121 may convert image signals (R, G, B) provided from the outside, into image data (R', G', B'), and may output the image data (R', G', B') to the data driving unit 160.

The driving voltage generator 131 may generate a plurality of driving voltages, e.g., a gate high voltage such as a first gate high voltage (Vgh) and a second gate high voltage (Vgh'), a gate low voltage (Vgl), a common voltage (Vcom), etc., from an operating voltage (Vd) provided from the outside. Then, the driving voltage generator 131 may output the generated driving voltages.

The driving voltage generator 131 may output the first gate high voltage (Vgh) and the gate low voltage (Vgl) to the gate driving unit 150, and may output the second gate high voltage (Vgh') and the gate low voltage (Vgl) to the light emission controller 170.

The driving voltage generator 131 may further include a voltage controller 200. The voltage controller 200 may generate the first gate high voltage (Vgh) and the second gate high voltage (Vgh'), from an operating voltage (Vd), according to a control signal (e.g., an enable signal (En)). Then, the voltage controller 200 may output the generated voltages.

In this case, the voltage controller 200 may output the first gate high voltage (Vgh) and the second gate high voltage (Vgh'), after controlling their levels according to a condition.

The reason why the voltage controller 200 outputs the first gate high voltage (Vgh) and the second gate high voltage (Vgh'), after controlling their levels according to a condition, is in order to prevent degradation of an OLED by compensating for change of a threshold voltage (Vth) of the switching transistor (ST1) and the sensing transistor (ST2) at each pixel (P) of the display panel 110. A configuration and an operation of the voltage controller 200 will be explained later in more detail.

The gate driving unit 150 may generate a gate signal, from the first gate high voltage (Vgh) and the gate low voltage (Vgl) output from the driving voltage generator 131, according to the gate control signal (CNT1) provided from the timing controller 121. The generated gate signal may be sequentially output to the plurality of gate lines (GL1~GLn) of the display panel 111.

Once the first gate high voltage (Vgh) is output after its level has been controlled by the voltage controller 200, the gate driving unit 150 may generate a gate signal after a level control in correspondence to the level control of the first gate high voltage (Vgh).

The data driving unit 160 may generate a data signal using the image data (R', G', B'), according to the data control signal (CTN2) provided from the timing controller 121. The generated data signal may be output to the plurality of data lines (DL1~DLm) of the display panel 111.

The light emission controller 170 may generate a light emission signal, from the second gate high voltage (Vgh') and the gate low voltage (Vgl) output from the driving voltage generator 131, according to the light emission control signal (CNT3) provided from the timing controller 121. The generated light emission signal may be sequentially output to the plurality of sensing lines (SL1~SLn) of the display panel 111.

Once the second gate high voltage (Vgh') is output after its level has been controlled by the voltage controller 200, the light emission controller 170 may generate a light emission signal after a level control in correspondence the level control of the second gate high voltage (Vgh').

The organic light emitting display 101 according to this embodiment may further include a gamma voltage generator (not shown). The gamma voltage generator may generate a plurality of gamma voltages, and may output the generated gamma voltages to the data driving unit 160. The data driving unit 160 may generate data signals from image data (R', G', B'), according to the generated gamma voltages. The gamma voltages may be composed of positive voltages and negative voltages.

Figure 9:
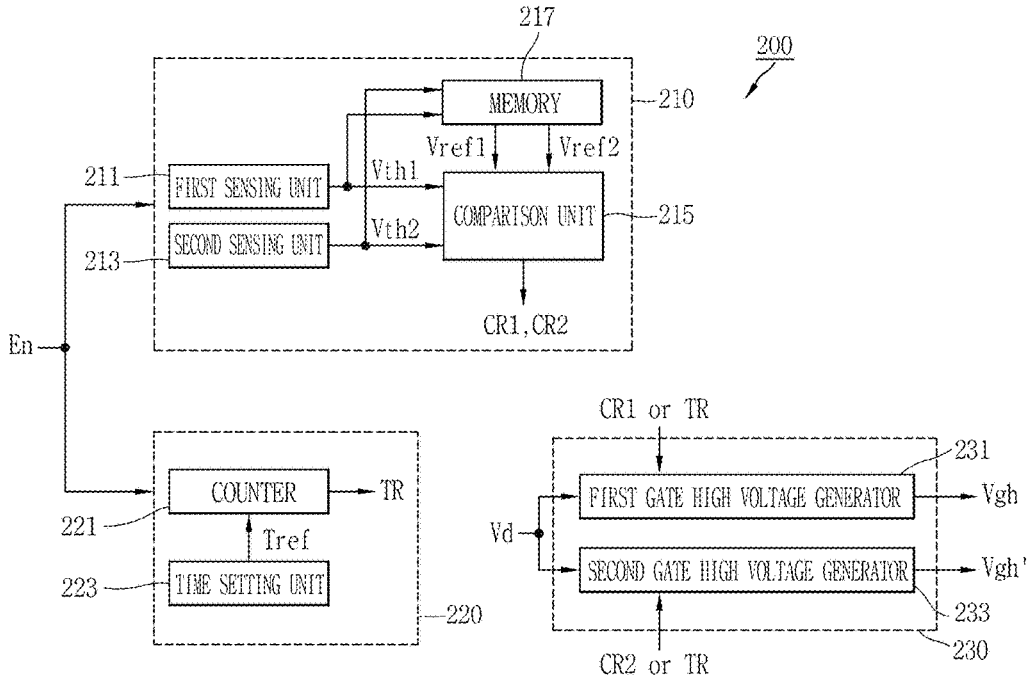
FIG. 9 is a view illustrating a detailed configuration of a voltage controller of FIG. 8.

FIG. 9 is a view illustrating a detailed configuration of the voltage controller of FIG. 8.

Referring to FIGS. 8 and 9, the voltage controller 200 may be composed of three modules, i.e., a sensing module 210, a driving time check module 220 and a voltage control module 230.

The sensing module 210 may sense a first threshold voltage (Vth1) and a second threshold voltage (Vths) from the display panel 111, and may output each comparison result (CR). The sensing module 210 may include a first sensing unit 211, a second sensing unit 213, a comparison unit 215, and a memory 217.

The first sensing unit 211 may sense a threshold voltage from the switching transistor (ST1) (i.e., a first threshold voltage Vth1) from each pixel (P) of the display panel 111. The second sensing unit 213 may sense a threshold voltage from the sensing transistor (ST2) (i.e., a second threshold voltage Vth2) from each pixel (P) of the display panel 111.

The first sensing unit 211 and the second sensing unit 213 may sense the first threshold voltage Vth1 and the second threshold voltage Vth2 at intervals of every frame or at intervals of a predetermined number of frames of the display panel 111. One of the first sensing unit 211 and the second sensing unit 213 may be operated, or both of the first sensing unit 211 and the second sensing unit 213 may be operated.

The comparison unit 215 may compare the first threshold voltage (Vth1) sensed by the first sensing unit 211, with a first reference voltage (Vref1). Further, the comparison unit 215 may compare the second threshold voltage (Vth2) sensed by the second sensing unit 213, with a second reference voltage (Vref2).

The first reference voltage (Vref1) may be a threshold voltage sensed by the first sensing unit 211 based on a previous sensing operation, and the second reference voltage (Vref2) may be a threshold voltage sensed by the second sensing unit 213 based on a previous sensing operation.

The comparison unit 215 may compare the first threshold voltage (Vth1) with the first reference voltage (Vref1), thereby outputting a first comparison result (CR1). For instance, when the first threshold voltage (Vth1) is larger than the first reference voltage (Vref1), the comparison unit 215 may output a first comparison result (CR1).

The comparison unit 215 may compare the second threshold voltage (Vth2) with the second reference voltage (Vref2), thereby outputting a second comparison result (CR2). For instance, when the second threshold voltage (Vth2) is larger than the second reference voltage (Vref2), the comparison unit 215 may output a second comparison result (CR2).

Each of the first comparison result (CR1) and the second comparison result (CR2) may be a pulse having a first level, e.g., a positive (+) level.

The memory 217 may store therein the first threshold voltage (Vth1) and the second threshold voltage (Vth2) sensed by the first sensing unit 211 and the second sensing unit 213. The stored first threshold voltage (Vth1) and second threshold voltage (Vth2) may be used as the first reference voltage (Vref1) and the second reference voltage (Vref2) when the comparison unit 215 performs a next comparison process, respectively.

The driving time check module 220 may count an operation time of the display panel 111, and may output a predetermined coefficient value (TR) from the counted operation time. The driving time check module 220 may include a time setting unit 223 and a counter 221.

In the time setting unit 223, a reference time (Tref) set by a user is stored.

For instance, a user may set one or more reference times (Tref) among a total operation time of the display panel 111. The reference time (Tref) may be an accumulated operation time of the display panel 111, set in unit of hours, e.g., 100 hours, 1000 hours, etc.

The counter 221 may count an operation time of the display panel 111. The counter 221 may count an operation time of the display panel 111, in unit of hours. That is, the counter 221 may count time taken from an initial time point when an image is displayed as each pixel (P) of the display panel 111 is operated, to a time point when the operation of the display panel 111 is completed, in an accumulated manner.

If the counted operation time of the display panel 111 is equal to or greater than the reference time (Tref) provided from the time setting unit 223, the counter 221 may output a predetermined coefficient value (TR). The coefficient value (TR) may be a total operation time of the display panel 111 counted by the counter 221.

The driving time check module 220 may be configured to use a timer (not shown). For instance, the driving time check module 220 may check an operation time of the display panel 111 using a timer, and may output a signal such as an alarm from the timer, when the checked operation time is equal to or greater than the reference time (Tref) set by a user.

One of the sensing module 210 and the driving time check module 220 may be operated, or both of the sensing module 210 and the driving time check module 220 may be operated, according to a control signal provided from the outside, e.g., an enable signal (En) provided from the timing controller 121.

The voltage control module 230 may generate a gate high voltage, e.g., a first gate high voltage (Vgh) and a second gate high voltage (Vgh'), from an operating voltage (Vd) provided from the outside, after a level control. The voltage control module 230 may include a first gate high voltage generator 231 and a second gate high voltage generator 233.

The first gate high voltage generator 231 may generate a level-controlled first gate high voltage (Vgh), from an operating voltage (Vd), according to a first comparison result (CR1) output from the sensing module 210, or a coefficient value (TR) output from the driving time check module 220. Then, the first gate high voltage generator 231 may output the generated level-controlled first gate high voltage (Vgh).

That is, the first gate high voltage generator 231 may generate a first gate high voltage (Vgh) reduced in level than the original gate high voltage, according to a first comparison result (CR1) or a coefficient value (TR), and may output the first gate high voltage (Vgh).

The level-reduced first gate high voltage (Vgh) output from the first gate high voltage generator 231 may be provided to the gate driving unit 150. The gate driving unit 150 may generate a gate signal, using the first gate high voltage (Vgh). In this instance, the gate driving unit 150 may generate a gate signal reduced in level than the original gate signal. Then, the gate driving unit 150 may output the generated gate signal to the switching transistor (ST1) of each pixel (P), through the gate line (GL) of the display panel 111.

The second gate high voltage generator 233 may generate a level-controlled second gate high voltage (Vgh'), from an operating voltage (Vd), according to a second comparison result (CR2) output from the sensing module 210, or a coefficient value (TR) output from the driving time check module 220. Then, the second gate high voltage generator 233 may output the generated level-controlled second gate high voltage (Vgh').

That is, the second gate high voltage generator 233 may generate a second gate high voltage (Vgh') increased in level than the original gate high voltage, according to a second comparison result (CR2) or a coefficient value (TR). Then, the second gate high voltage generator 233 may output the generated second gate high voltage (Vgh').

The level-increased second gate high voltage (Vgh') output from the second gate high voltage generator 233 may be provided to the light emission controller 170. The light emission controller 170 may generate a light emission signal, using the second gate high voltage (Vgh'). In this instance, the light emission controller 170 may generate a light emission signal increased in level than the original light emission signal. The light emission controller 170 may output the generated light emission signal to the sensing transistor (ST2) of each pixel (P), through the sensing line (SL) of the display panel 111.

Hereinafter, an operation of the organic light emitting display 101 including the voltage controller 200, according to another embodiment of the present invention will be explained in more detail with reference to the attached drawings.

Figure 10:
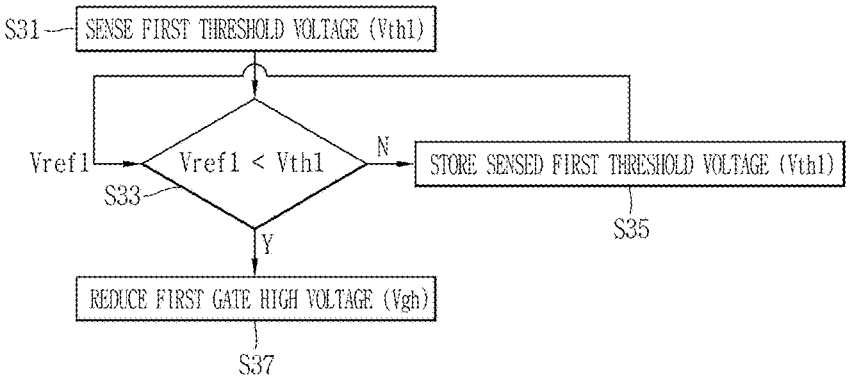
FIG. 10 is a flowchart illustrating operations of the organic light emitting display of FIG. 8 according to an embodiment of the present invention.

FIG. 10 is a flowchart illustrating operations of the organic light emitting display of FIG. 8 according to an embodiment of the present invention.

Referring to FIGS. 8 to 10, the voltage controller 200 of the driving voltage generator 131 may sense a threshold voltage of the switching transistor (ST1), i.e., a first threshold voltage (Vth1), at each pixel (P) of the display panel 111 (S31).

For instance, the sensing module 210 of the voltage controller 200 may be operated by an enable signal (En) provided from the timing controller 121. The first sensing unit 211 of the sensing module 210 may sense a threshold voltage of the switching transistor (ST1), i.e., a first threshold voltage (Vth1), at each pixel (P) of the display panel 111.

Then, the sensed first threshold voltage (Vth1) is provided to the comparison unit 215, and the comparison unit 215 may compare the first threshold voltage (Vth1) with a first reference voltage (Vref1) (S33).

In this case, the first reference voltage (Vref1) may be a voltage stored in the memory 217 of the sensing module 210, which may be a threshold voltage of the switching transistor ST1 sensed by the first sensing unit 211 at a previous sensing operation.

If the first threshold voltage (Vth1) is greater than the first reference voltage (Vref1) as a comparison result (Y), the comparison unit 215 may output a first comparison result (CR1). The first comparison result (CR1) may be output to the voltage control module 230.

The comparison unit 215 may output the first comparison result (CR1) when the first threshold voltage (Vth1) is greater than the first reference voltage (Vref1) by a predetermined level, e.g., a positive integer (+).

The first gate high voltage generator 231 of the voltage control module 230 may generate a first gate high voltage (Vgh) from an operating voltage (Vd), according to the first comparison result (CR1) output from the comparison unit 215. The generated first gate high voltage (Vgh) may be reduced in level than the original first gate high voltage (S37).

The first gate high voltage generator 231 of the voltage control module 230 may generate a first gate high voltage (Vgh) according to the first comparison result (CR1). The generated first gate high voltage (Vgh) may be reduced in level than the original first gate high voltage, by a predetermined level, e.g., a negative integer (−).

The level-reduced first gate high voltage (Vgh) output from the first gate high voltage generator 231 is provided to the gate driving unit 150. The gate driving unit 150 generates a gate signal, using the first gate high voltage (Vgh). In this instance, the gate driving unit 150 may generate a gate signal reduced in level than the original gate signal. Then, the gate driving unit 150 may output the generated gate signal to the switching transistor (ST1) of each pixel (P), through the gate line (GL) of the display panel 111.

That is, in this embodiment, a level of a gate signal provided to a gate electrode of a switching transistor (ST1) of each pixel (P) is controlled according to a level of a first threshold voltage (Vth1) sensed by the switching transistor (ST1). As a result, a change of the first threshold voltage (Vth1) of the switching transistor (ST1) can be compensated, and thus the amount of current provided to the OLED can be increased. This can increase brightness of the display panel 111, and prevent degradation of each pixel (P), thereby increasing a lifespan of the organic light emitting display 101.

If the sensed first threshold voltage (Vth1) is smaller than the first reference voltage (Vref1) as a comparison result by the comparison unit 215 (N), the sensed first threshold voltage (Vth1) may be stored in the memory 217 (S35). The stored first threshold voltage (Vth1) may be used as a first reference voltage (Vref1) when the comparison unit 215 performs a next comparison process.

Figure 11:
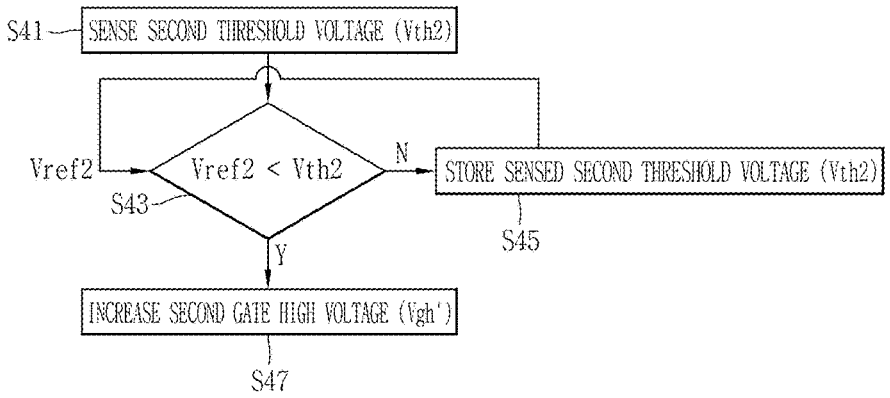
FIG. 11 is a flowchart illustrating operations of the organic light emitting display of FIG. 8 according to another embodiment of the present invention.

FIG. 11 is a flowchart illustrating operations of the organic light emitting display of FIG. 8 according to another embodiment of the present invention.

Referring to FIGS. 8, 9 and 11, the voltage controller 200 of the driving voltage generator 131 may sense a threshold voltage of the sensing transistor (ST2), i.e., a second threshold voltage (Vth2), at each pixel (P) of the display panel 111 (S41).

For instance, the sensing module 210 of the voltage controller 200 may be operated by an enable signal (En) provided from the timing controller 121. The second sensing unit 213 of the sensing module 210 may sense a threshold voltage of the sensing transistor (ST2), i.e., a second threshold voltage (Vth2), at each pixel (P) of the display panel 111.

Then, the sensed second threshold voltage (Vth2) is provided to the comparison unit 215, and the comparison unit 215 may compare the second threshold voltage (Vth2) with a second reference voltage (Vref2) (S43).

In this case, the second reference voltage (Vref2) may be a voltage stored in the memory 217 of the sensing module 210, which may be a threshold voltage of the sensing transistor ST2 sensed by the second sensing unit 213 at a previous sensing operation.

If the second threshold voltage (Vth2) is greater than the second reference voltage (Vref2) as a comparison result (Y), the comparison unit 215 may output a second comparison result (CR2). The second comparison result (CR2) may be output to the voltage control module 230.

The comparison unit 215 may output the second comparison result (CR2) when the second threshold voltage (Vth2) is greater than the second reference voltage (Vref2) by a positive integer (+).

The second gate high voltage generator 233 of the voltage control module 230 may generate a second gate high voltage (Vgh') from an operating voltage (Vd), according to the second comparison result (CR2) output from the comparison unit 215. The generated second gate high voltage (Vgh') may be increased in level than the original second gate high voltage (S47).

The second gate high voltage generator 233 of the voltage control module 230 may generate a second gate high voltage (Vgh') according to the second comparison result (CR2). The generated second gate high voltage (Vgh') may be increased in level than the original second gate high voltage, by a positive integer (+).

The second gate high voltage (Vgh') generated from the second gate high voltage generator 233 is provided to the light emission controller 170. The light emission controller 170 generates a light emission signal, using the second gate high voltage (Vgh'). In this instance, the light emission controller 170 may generate a light emission signal increased in level than the original light emission signal. Then, the light emission controller 170 may output the generated light emission signal to the sensing transistor (ST2) of each pixel (P), through the sensing line (SL) of the display panel 111.

That is, in this embodiment, a level of a light emission signal provided to a gate electrode of a sensing transistor (ST2) of each pixel (P) is controlled according to a level of a second threshold voltage (Vth2) sensed by the sensing transistor (ST2). As a result, change of the second threshold voltage (Vth2) of the sensing transistor (ST2) can be compensated, and thus the amount of current provided to the OLED can be increased. This can increase brightness of the display panel 111, and prevent degradation of each pixel (P), thereby increasing a lifespan of the organic light emitting display 101.

If the sensed second threshold voltage (Vth2) is smaller than the second reference voltage (Vref2) as a comparison result by the comparison unit 215 (N), the sensed second threshold voltage (Vth2) may be stored in the memory 217 (S45). The stored second threshold voltage (Vth2) may be used as a second reference voltage (Vref2) when the comparison unit 215 performs a next comparison process.

The configuration to output the first gate high voltage (Vgh) aforementioned with reference to FIG. 10, and the configuration to output the second gate high voltage (Vgh') aforementioned with reference to FIG. 11 may be implemented together.

For instance, the sensing module 210 may sense a first threshold voltage (Vth1) of the display panel 111, and output a first comparison result (CR1). Alternatively, the sensing module 210 may sense a second threshold voltage (Vth2) of the display panel 111, and output a second comparison result (CR2). Still alternatively, the sensing module 210 may sense both a first threshold voltage (Vth1) and a second threshold voltage (Vth1) of the display panel 111, and output both a first comparison result (CR1) and a second comparison result (CR2).

Once the sensing module 210 outputs the first comparison result (CR1) or the second comparison result (CR2), the voltage control module 230 may generate a first gate high voltage (Vgh) reduced in level than the original gate high voltage, and a second gate high voltage (Vgh') increased in level than the original gate high voltage, according to the first comparison result (CR1) or the second comparison result (CR2). Then the voltage control module 230 may output the generated first gate high voltage (Vgh) and second gate high voltage (Vgh')

The first gate high voltage (Vgh) may be output to the gate driving unit 150. The gate driving unit 150 may generate a gate signal reduced in level according to the first gate high voltage (Vgh), and may output the generated gate signal to the switching transistor (ST1) of each pixel (P) of the display panel 111.

The second gate high voltage (Vgh') may be output to the light emission controller 170. The light emission controller 170 may generate a light emission signal increased in level according to the second gate high voltage (Vgh'), and may output the generated light emission signal to the sensing transistor (ST2) of each pixel (P) of the display panel 111.

Figure 12:
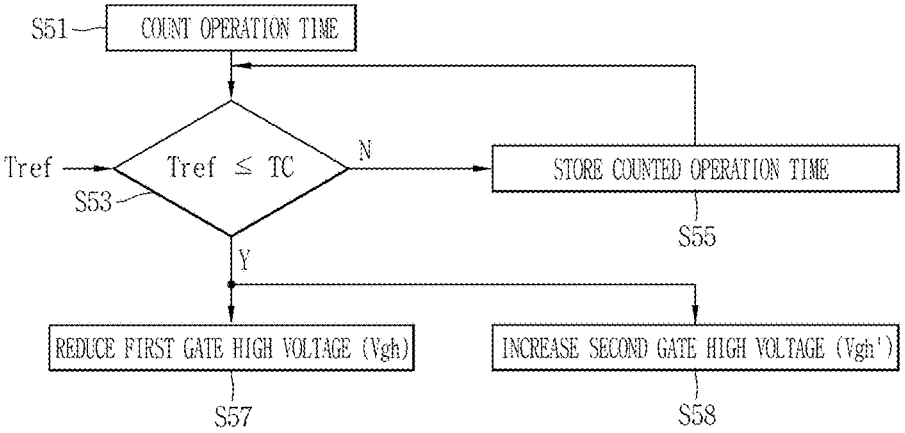
FIG. 12 is a flowchart illustrating operations of the organic light emitting display of FIG. 8 according to still another embodiment of the present invention.

FIG. 12 is a flowchart illustrating operations of the organic light emitting display of FIG. 8 according to still another embodiment of the present invention.

Referring to FIGS. 8, 9 and 12, the voltage controller 200 of the driving voltage generator 131 may sense an operation time of the display panel 111 (S51).

The driving time check module 220 of the voltage controller 200 may be operated according to an enable signal (En) provided from the timing controller 121. The counter 221 of the driving time check module 200 may count an operation time of the display panel 111 from an initial operation time point, in unit of hours.

The counted operation time may be compared with a reference time (Tref) stored in the time setting unit 223 (S53).

If the counted operation time is greater than or equal to the reference time (Tref) as a comparison result (Y), the counter 221 may output a coefficient value (TR). The coefficient value (TR) may be a counted operation time of the display panel 111. The coefficient value (TR) may be output to the voltage control module 230.

The first gate high voltage generator 231 of the voltage control module 230 may generate a first gate high voltage (Vgh) from an operating voltage (Vd), according to the coefficient value (TR) output from the counter 221. The generated first gate high voltage (Vgh) may be a voltage reduced in level than the original gate high voltage (S57).

The second gate high voltage generator 233 of the voltage control module 230 may generate a second gate high voltage (Vgh') from an operating voltage (Vd), according to the coefficient value (TR) output from the counter 221. The generated second gate high voltage (Vgh') may be a voltage increased in level than the original gate high voltage (S58).

Each of the first gate high voltage (Vgh) and the second gate high voltage (Vgh') may be a voltage reduced or increased in level than the original gate high voltage by an integer rather than '0'.

The first gate high voltage (Vgh) may be output to the gate driving unit 150. The gate driving unit 150 may generate a gate signal reduced in level according to the first gate high voltage (Vgh), and may output the generated gate signal to the switching transistor (ST1) of each pixel (P) of the display panel 111.

The second gate high voltage (Vgh') may be output to the light emission controller 170. The light emission controller 170 may generate a light emission signal increased in level according to the second gate high voltage (Vgh'), and may output the generated light emission signal to the sensing transistor (ST2) of each pixel (P) of the display panel 111.

That is, in this embodiment, a level of a gate signal and a light emission signal provided to each gate electrode of a switching transistor (ST1) and a sensing transistor (ST2) of each pixel (P) is controlled according to an operation time of the organic light emitting display 101. As a result, threshold voltages of the switching transistor (ST1) and the sensing transistor (ST2), which are variable according to an operation time of the organic light emitting display 101, can be compensated. Therefore, the amount of current provided to the OLED can be increased. This can increase brightness of the display panel 111, prevent degradation of each pixel (P), and increase a lifespan of the organic light emitting display 101.

If the counted operation time is smaller than the reference time (Tref) as a comparison result (N), the counter 221 may store the operation time of the display panel 111 by accumulating a coefficient value (TR) at a next counting operation (S55).

The following tables 1 and 2 show that brightness of a display panel is increased by compensating for a threshold voltage according to a change amount of the threshold voltage, in the organic light emitting display according to the present invention.

TABLE 1

| Change amount of Vth | Vgh | 24 V | 27 V |
|---|---|---|---|
| 1.5 V | OLED Current | 2.41E−7 | 2.51E−07 |
| | Brightness Ratio | 92.6% | 96.1% |

TABLE 2

| Change amount of Vth | Vgh | 27 V | 30 V |
|---|---|---|---|
| 3.0 V | OLED Current | 2.41E−07 | 2.51E−07 |
| | Brightness Ratio | 92.6% | 96.1% |

As can be seen from the tables 1 and 2, the organic light emitting display according to the present invention can sense a change amount of a threshold voltage of a switching device at each pixel, and increase a level of a gate high voltage, thereby having an enhanced brightness.

In the tables 1 and 2, the Vth change amount indicates a change amount of a threshold voltage of a sensing transistor at each pixel, and Vgh indicates a gate high voltage for generating a light emission signal provided to a sensing transistor of each pixel.

As can be seen from the table 1, as a gate high voltage is increased by 3V, a level of a light emission signal provided to a sensing transistor is increased, and thus brightness of the organic light emitting display is increased by 3.8%.

As can be seen from the table 2, as a gate high voltage is increased by 3V, a level of a light emission signal provided to a sensing transistor is increased, and thus brightness of the organic light emitting display is increased by 2.8%.

Figure 13:
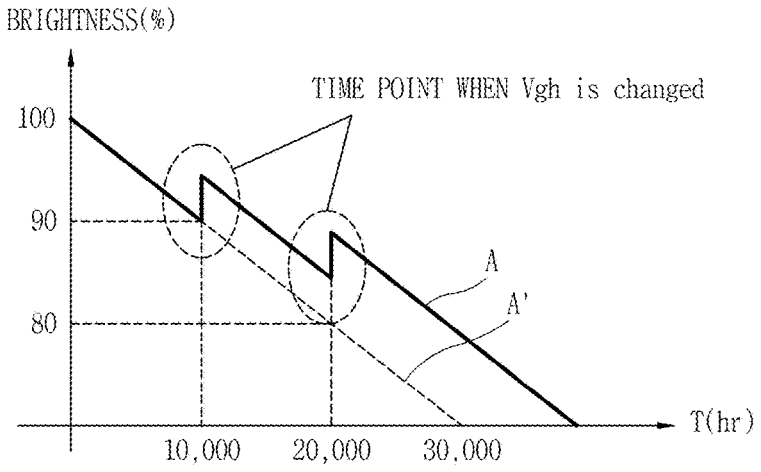
FIG. 13 is a graph illustrating that brightness of a display panel is increased by compensating for a threshold voltage according to an operation time, in an organic light emitting display according to the present invention.

FIG. 13 is a graph illustrating that brightness of a display panel is increased by compensating for a threshold voltage according to an operation time, in an organic light emitting display according to the present invention.

As shown in FIG. 13, the organic light emitting display according to the present invention can have an enhanced brightness, by controlling a level of a signal provided to a switching device of each pixel (e.g., a switching transistor and a sensing transistor of each pixel), by increasing or reducing a level of a gate high voltage within a set operation time.

As an example, as a level of a gate high voltage is increased or reduced within a set operation of 10,000 hours, a level of a gate signal and a light emission signal provided to a switching transistor and a sensing transistor, respectively can be increased and reduced. This can enhance brightness of the organic light emitting display.

As another example, as a level of a gate high voltage is increased or reduced within a set operation of 20,000 hours, a level of a gate signal and a light emission signal provided to a switching transistor and a sensing transistor, respectively can be increased and reduced. This can enhance brightness of the organic light emitting display.

As brightness of the organic light emitting display is increased by controlling a level of signals provided to the switching transistor and the sensing transistor, the organic light emitting display can have a lifespan (A) increased as compared to a related art lifespan (A') by about 19%.

The present invention may have at least the following advantages. As a gate signal is provided to a display panel after its level has been changed according to a set time or a set threshold voltage, degradation of a pixel due to change of a threshold voltage can be prevented. The organic light emitting display of the present invention can have a prolonged a lifespan by preventing lowering of brightness of a display panel.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display, comprising:

a display panel including a plurality of gate lines, a plurality of data line, a plurality of sensing lines, and a plurality of pixels disposed at intersections between the gate lines and the data lines, wherein the pixel is provided with a switching transistor, a driving transistor, a sensing transistor and an organic light emitting diode;

a driving voltage generator configured to count an operation time of the display panel, and to output a gate high voltage after controlling a level of an original gate high voltage according to the counted operation time;

a gate driving unit configured to generate a gate signal according to a level-controlled gate high voltage output from the driving voltage generator, and to supply the generated gate signal to the switching transistor through the gate lines; and a light emission controller configured to generate a light emission signal according to the level-controlled gate high voltage output from the driving voltage generator, and to supply the generated light emission signal to the sensing transistor through the sensing lines, wherein the driving voltage generator comprises a driving time check module configured to compare the counted operation time with a reference time, and to output a coefficient value when the counted operation time is equal to or greater than the reference time; and a voltage control module configured to generate at least one of a first gate high voltage reduced in level than the original gate high voltage, and a second gate high voltage increased in level than the original gate high voltage, according to the coefficient value;

wherein the voltage control module outputs the first gate high voltage to the gate driving unit, and outputs the second gate high voltage to the light emission controller.

2. A method of driving an organic light emitting display, the method comprising:

counting an operation time of a display panel including pixels disposed at intersections between a plurality of gate lines and a plurality of data lines, each pixel provided with a switching transistor, a driving transistor, a sensing transistor and an organic light emitting diode;

comparing the counted operation time with a reference time, and outputting a coefficient value;

controlling a level of an original gate high voltage according to the coefficient value, and outputting a level-controlled gate high voltage;

generating a gate signal according to a level-controlled gate high voltage output, and supplying the generated gate signal to the switching transistor through the gate lines; and generating a light emission signal according to the level-controlled gate high voltage output, and supplying the generated light emission signal to the sensing transistor through the sensing lines;

wherein in the step of outputting a coefficient value is compared the counted operation time with the reference time, to output a coefficient value when the counted operation time is equal to or greater than the reference time, and generating at least one of a first gate high voltage reduced in level than the original gate high voltage, and a second gate high voltage increased in level than the original gate high voltage, according to the coefficient value;

wherein in the step of controlling and outputting a level of an original gate high voltage, a first gate high voltage reduced in level than the original gate high voltage is generated according to the coefficient value, and the first gate high voltage is output to the switching transistor of each pixel.

3. The method of claim 2, wherein when the counted operation time is equal to or greater than the reference time, the coefficient result is output, and wherein in the step of controlling and outputting a level of an original gate high voltage, a second gate high voltage increased in level than the original gate high voltage is generated according to the coefficient value, and the second gate high voltage is output to the sensing transistor of each pixel.

* * * * *